United States Patent [19]

Wolf

[11] 4,188,746

[45] Feb. 19, 1980

[54] RESPONSIVE DOLL

[76] Inventor: Tobin Wolf, 285 Aycrigg Ave., Passaic, N.J. 07055

[21] Appl. No.: 767,491

[22] Filed: Feb. 10, 1977

[51] Int. Cl.[2] ..... A63H 29/16

[52] U.S. Cl. ..... 46/44; 46/164; 46/120

[58] Field of Search ..... 46/44, 116, 119, 118, 46/120, 265, 169 R, 167, 164; 137/625.11, 625.46

[56] References Cited

U.S. PATENT DOCUMENTS

| | | | |
|---|---|---|---|
| 1,585,340 | 5/1926 | Fitzgerald | 46/167 |
| 1,973,656 | 9/1934 | Penati | 137/625.11 |
| 2,384,318 | 9/1945 | Le Bleu | 137/625.11 |
| 3,462,876 | 8/1969 | Kirschenmann | 46/169 R X |
| 3,594,942 | 7/1971 | Hollingsworth | 46/44 |
| 3,600,845 | 8/1971 | Mendigal | 46/44 |
| 3,724,124 | 4/1973 | Foley et al. | 46/97 |
| 3,740,893 | 6/1973 | Shinoda | 46/44 |
| 3,996,695 | 12/1976 | Sapkus et al. | 46/118 |
| 4,057,928 | 11/1977 | Terzian | 46/118 X |
| 4,067,138 | 1/1978 | Cedarholm et al. | 46/44 |

*Primary Examiner*—Russell R. Kinsey
*Assistant Examiner*—Mickey Yu
*Attorney, Agent, or Firm*—Jay M. Cantor

[57] ABSTRACT

A toy figure, such as a doll, is provided with movable arms and eyes and a movable head. The movable parts of the doll are selectively actuated to move in a reciprocating manner to make such gestures as "yes", "no" to "wave" to "clap" hands or to "wink" an eye. A manually controlled pneumatic system, including a plurality of bellows mechanisms, is provided for actuating the selected movable part.

19 Claims, 19 Drawing Figures

Fig. 9
Fig. 9A
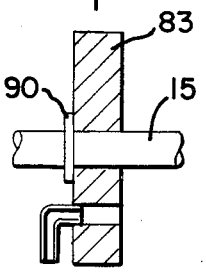
Fig. 9B
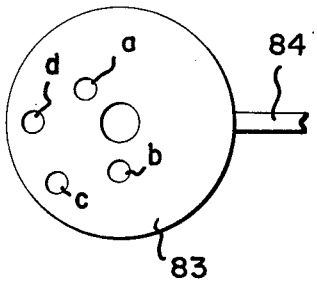
Fig. 9C
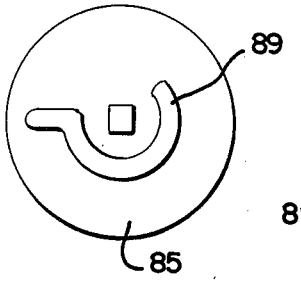
Fig. 9D
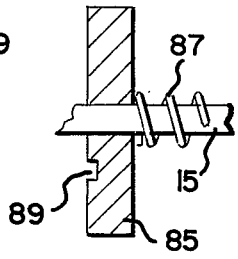
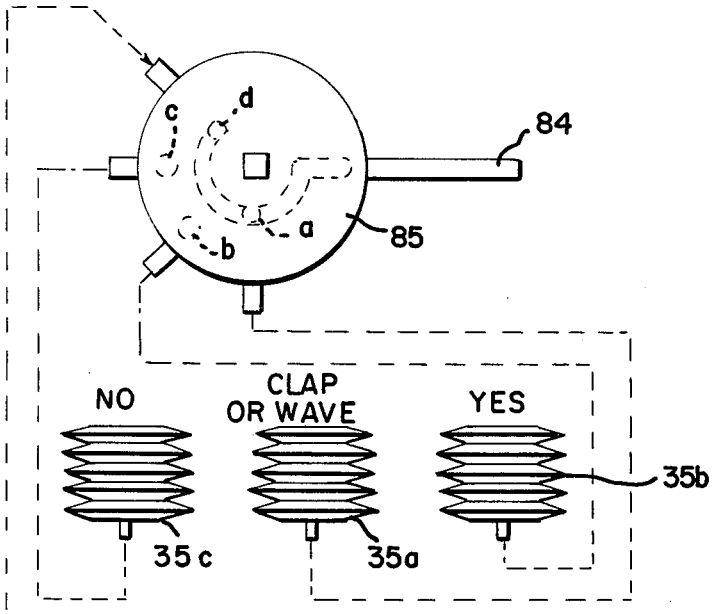
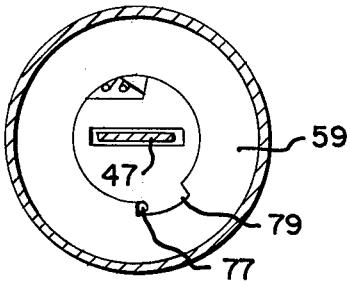
Fig. 7
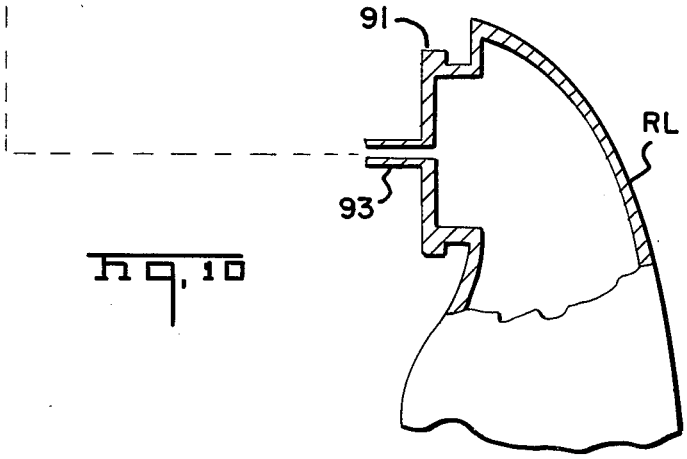
Fig. 10
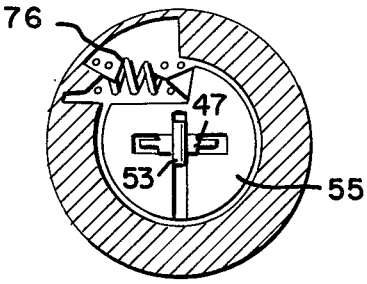
Fig. 4

RESPONSIVE DOLL

BACKGROUND OF THE INVENTION

This invention relates to a toy figure, preferably a doll having movable parts which are individually or collectively capable of being actuated by an internal mechanism manually energized by an operator.

Dolls that perform realistic actions are highly appealing to children. Especially so, when such actions are in response to a specific request by a child for the doll to make such motions as waving goodbye, clapping hands, nodding its head, moving its eyes and other such movements. As hereinafter described, individual parts may be selected for special movements to carry out the child's request without any apparent manipulation of the parts by an operator.

SUMMARY OF THE INVENTION

In accordance with this invention the arms of the doll and the head are movably mounted to the body. At least one eye may be movably mounted in the head. A pneumatic system including a plurality of individually actuated bellows mechanisms is supported internally of the hollow body, each of the mechanisms when actuated cooperating with one of the movable parts to reciprocate it. One of the doll's legs is hollow and of resilient material and is provided with an opening into a tube within the doll's body which extends to an adjustable selector valve which in turn diverts the air compressed by squeezing the leg to a selected bellows. Repeatedly squeezing the leg will cause the selected bellows to expand and move the part in one direction, a spring returning the part to normal when the leg is released. The selector valve is adjusted by moving one of the arms. When the arm is positioned forwardly and the other arm is positioned parallel thereto, the arms are moved toward and away from each other to "clap" hands when the leg is squeezed. When the said arm is moved upwardly a part thereon cooperates with the same bellows to cause the arm to "wave". When the arm is moved to other individual positions, the valve is adjusted to divert the air to corresponding individual bellows to actuate it to move the head in either a "yes" or "no" gesture. The doll may also be provided with a movable eye which is caused to "wink" by a puff of air directed against a vane extending inwardly therefrom into the head. Such puff of air is provided by diverting the compressed air from the squeezed leg to a tube opening adjacent the vane by moving said arm to properly adjust the valve.

It is one object of this invention to provide a doll having movable parts with an internal manually controlled mechanism for reciprocating at least one of the parts in a desired manner.

It is another object of the invention to provide a doll such as above, wherein the manually controlled mechanism is air operated.

It is a further object of this invention to provide a doll having movable parts selectively actuated by an individual air-controlled mechanism.

It is an additional object of this invention to provide a doll with movable parts which are actuated by compressed air derived by pressing another part of the doll.

The above and still further objects will become apparent as the description of the invention proceeds with reference to the Figures of the drawing in which.

Figure 1:
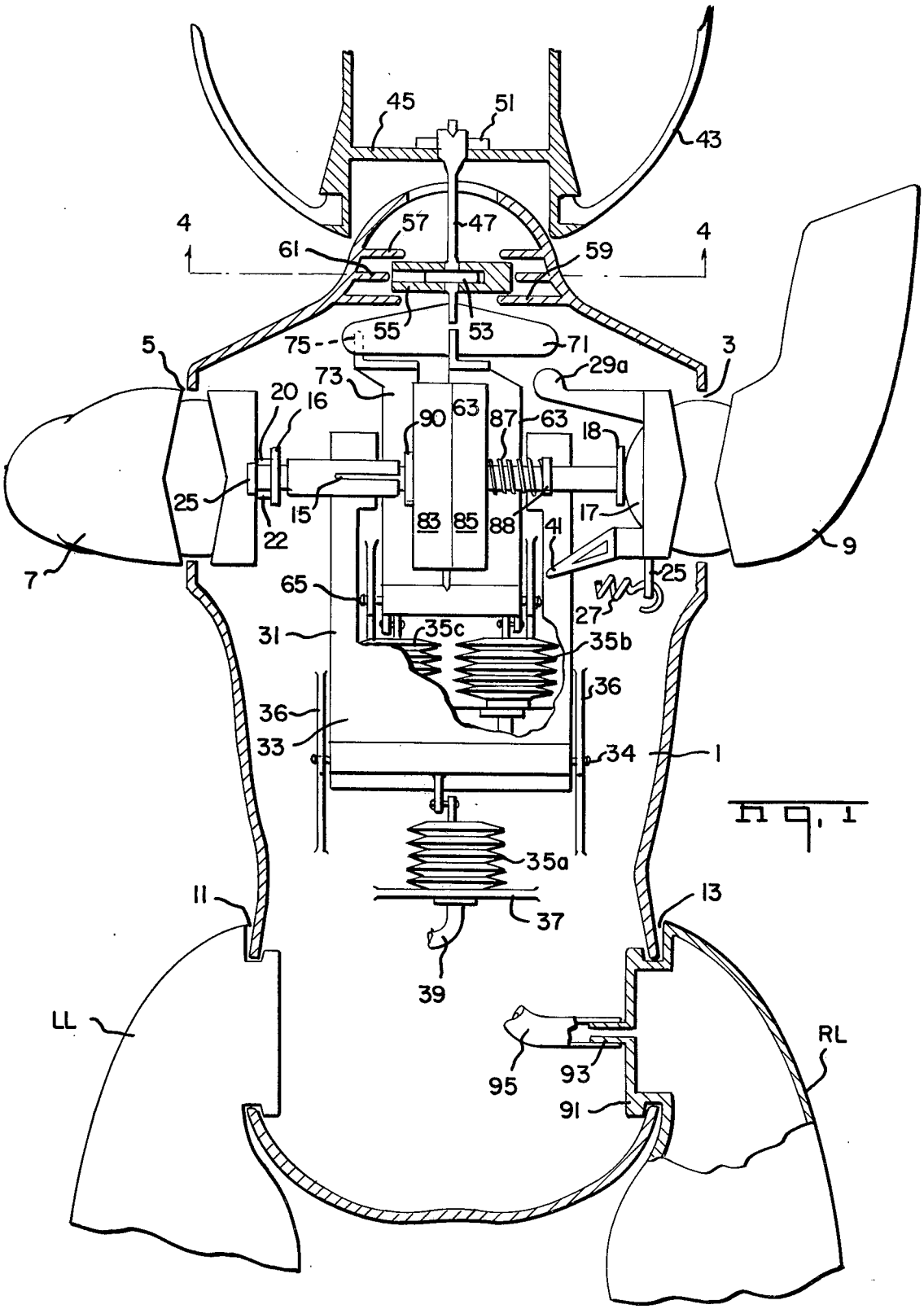
FIG. 1 is a rear view of the interior of a doll body with the back thereof moved and parts of the doll in section.
Figure 2:
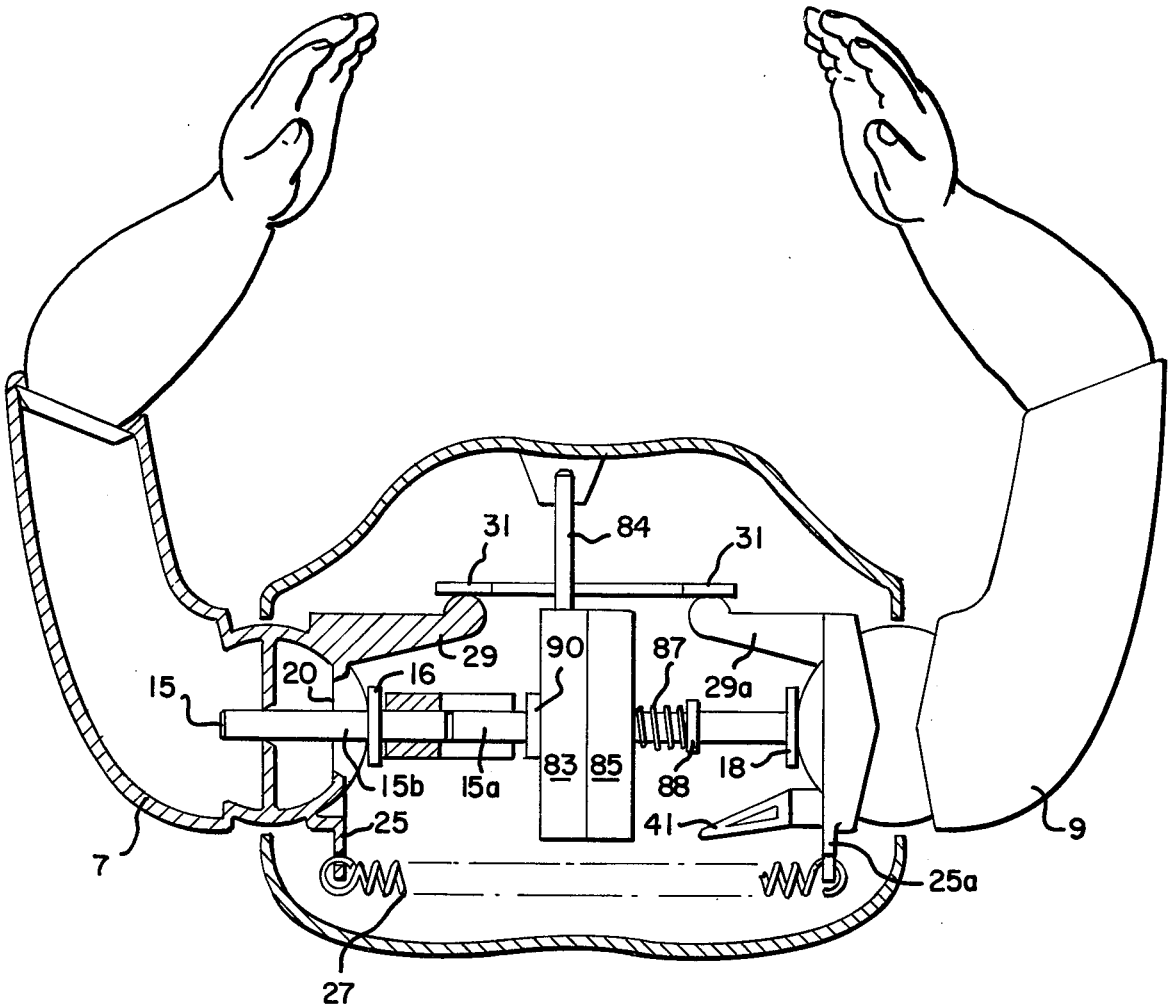
FIG. 2 is a top view of the doll with the torso and left arm cut by a horizontal plane passing through the center of the arm sockets.
Figure 2A:
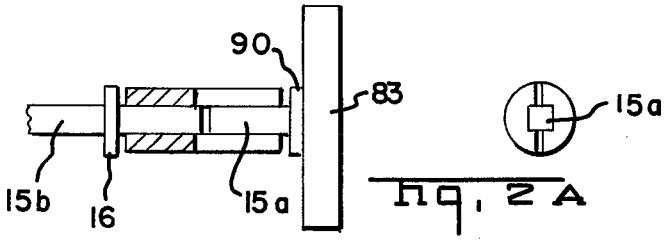
Figure 3:
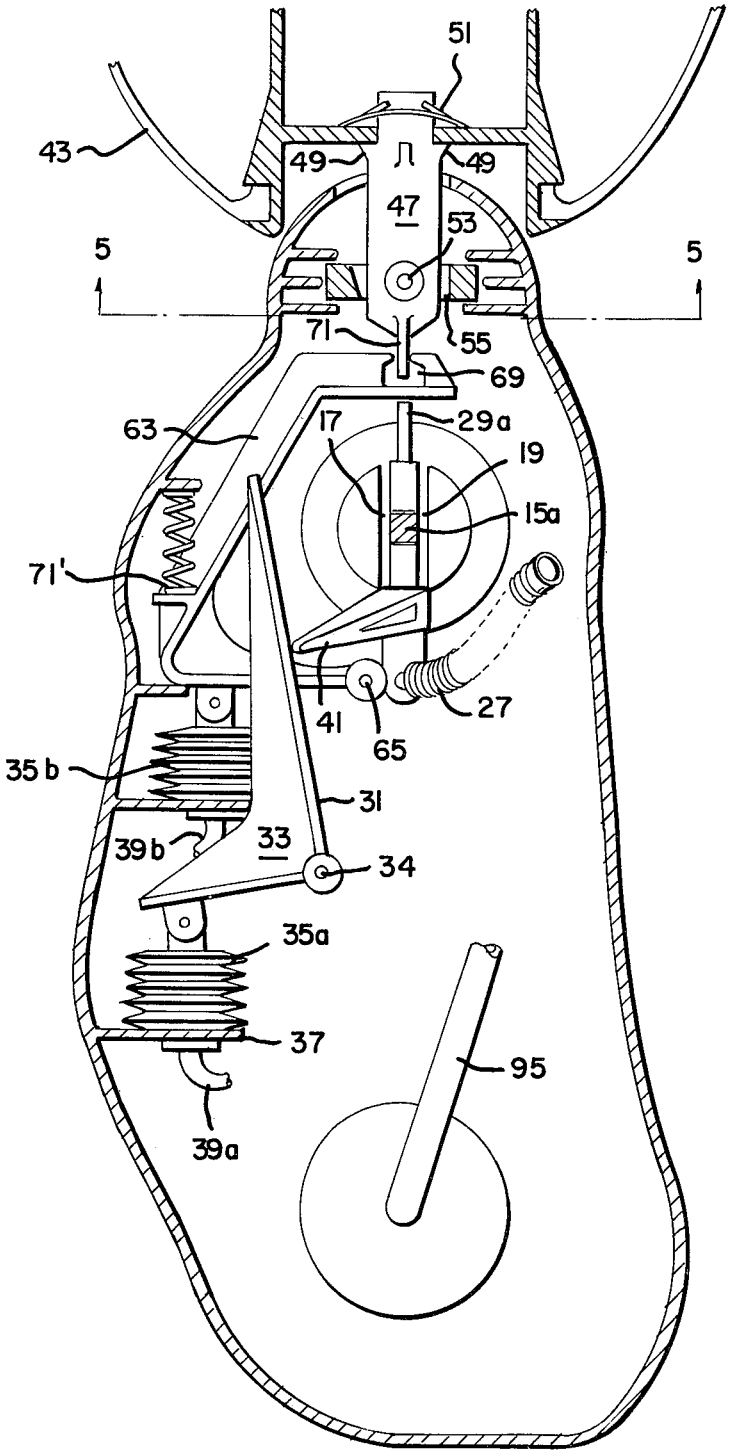
Figure 6:
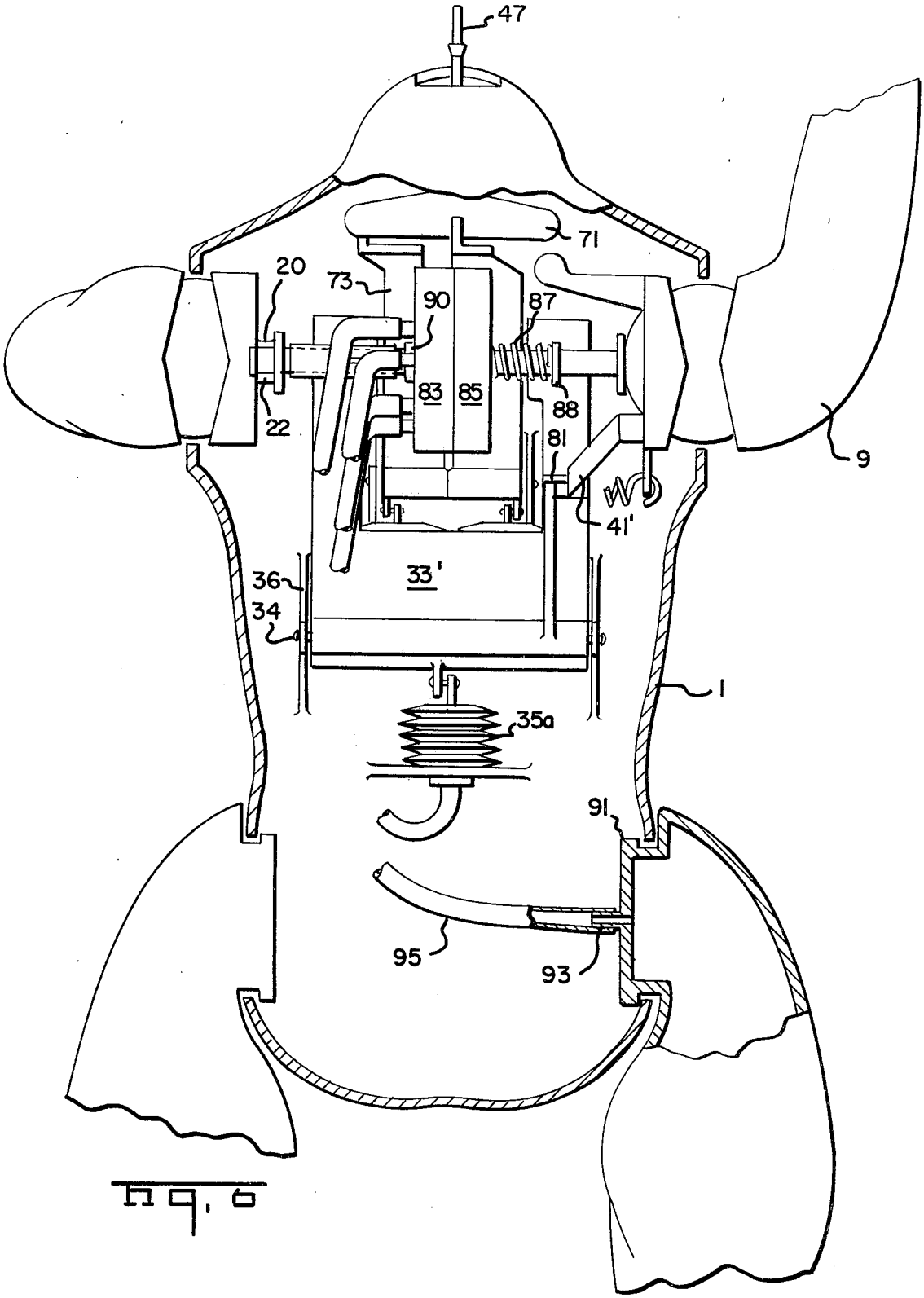

FIG. 2*a* is a detail view of one portion of a shaft for mounting the arms;

FIG. 3 is a side view of the doll cut by a vertical bisecting plane;

FIG. 4 is a cross-section along line 4—4 of FIG. 1;

FIG. 5 is a cross-section along line 5—5 of FIG. 3;

FIG. 6 is a view similar to FIG. 1 showing an alternate mechanism for moving one of the arms.

Figure 7:
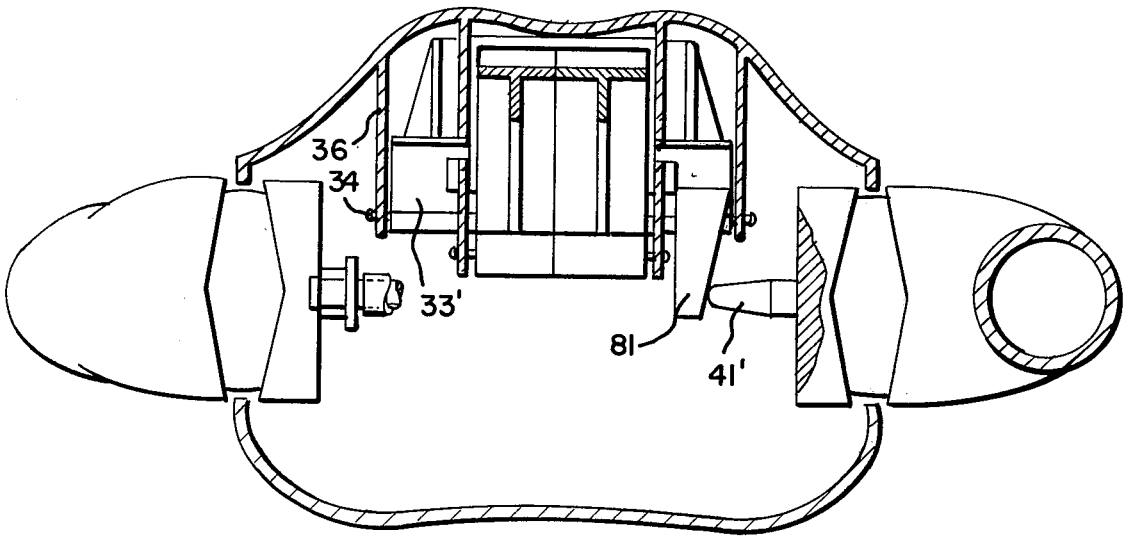
Figure 13B:
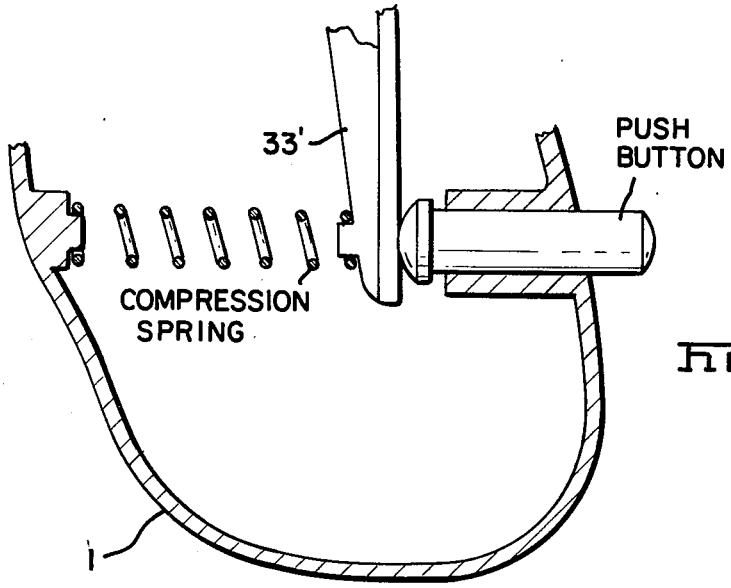
Figure 8:
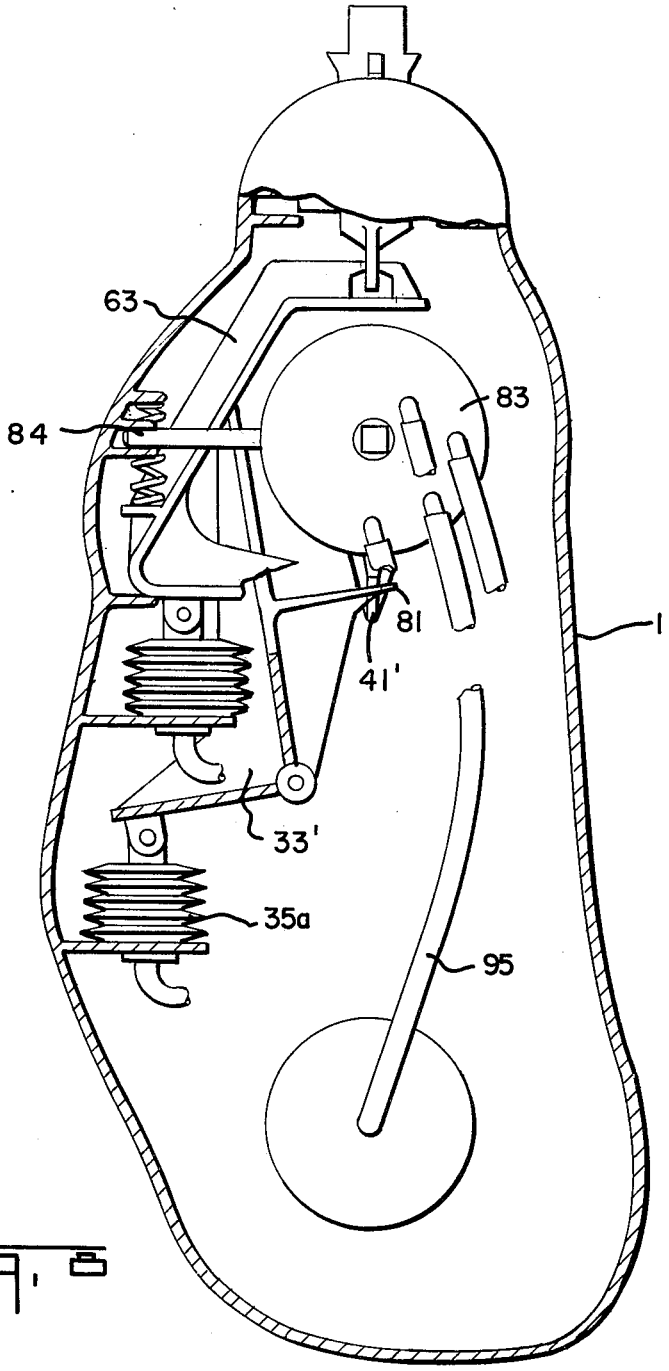
Figure 11:
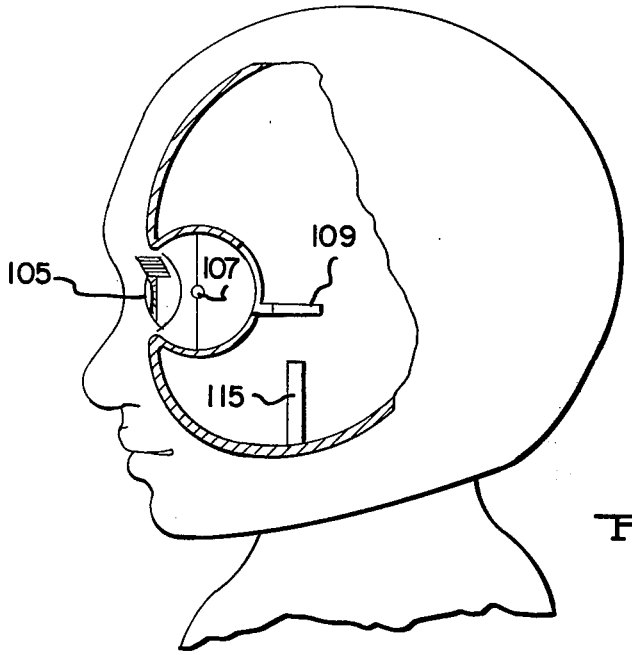
Figure 12A:
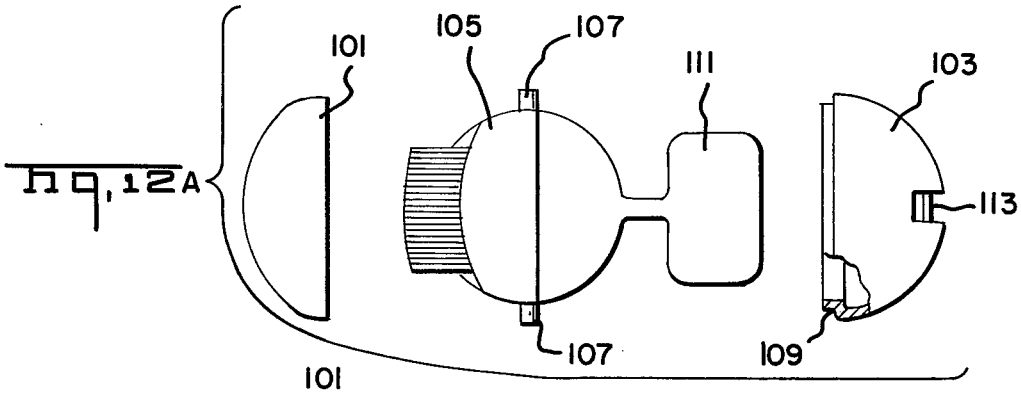
Figure 12B:
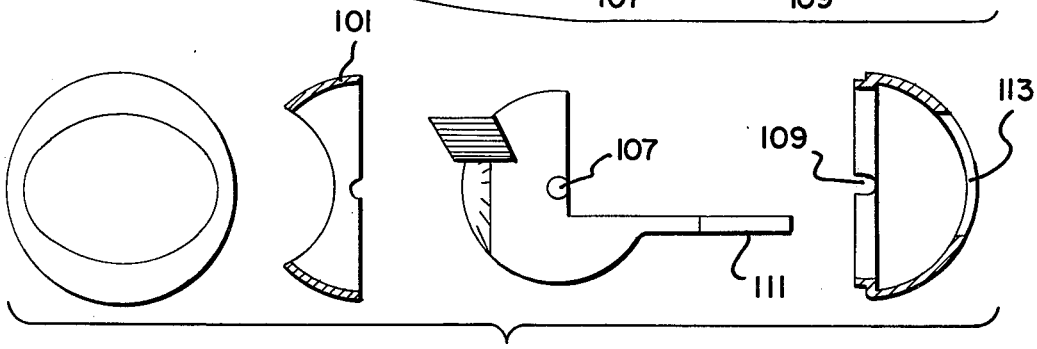
Figure 13:
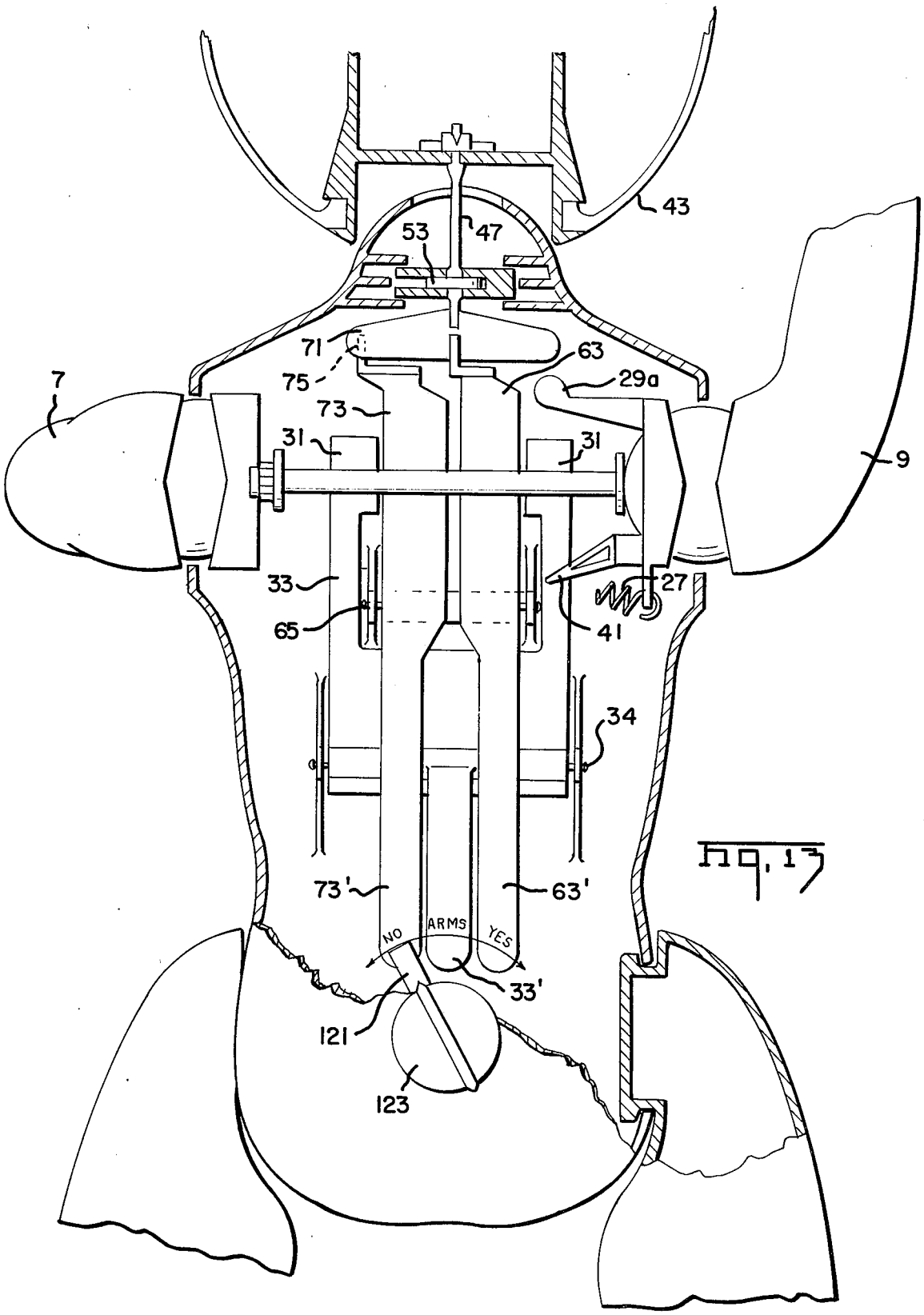

FIG. 7 is a view similar to FIG. 2 with some of the parts omitted but showing the above alternate mechanism;

FIG. 8 is a view similar to FIG. 3 in which a side view of the above mentioned alternate mechanism is shown;

FIG. 9A is a sectional view of a disc mounted on a shaft and provided with openings, only one of which is shown, and into which the end of a tube extends;

FIG. 9B is a front view of the disc of FIG. 9A;

FIG. 9C is a front view of a second disc provided with a channel which cooperates with the openings in the disc of FIG. 9A when they are in assembled relation;

FIG. 9D is a sectional view of the disc of FIG. 9C mounted on a shaft;

FIG. 10 is a schematic of the pneumatic system for controlling movements of the doll's limbs;

FIG. 11 is a side view of the doll's head with a portion cut away to show a doll's eye mounted in its socket;

FIG. 12*a* is an exploded view of the eye structure from the top thereof;

FIG. 12*b* is an exploded view of the eye structure of FIG. 12*a* from the side thereof;

FIG. 13 shows the interior mechanism of a modification of the above; and

FIG. 13*a* is a further modification in accordance with the present invention.

The structure and operation of the doll of this invention will now be described with specific reference to the drawings. The torso 1 of the doll is hollow and is provided with opposite openings 3 and 5 at its sides for movably supporting the respective arms 7 and 9 therein and openings 11 and 13 for movably supporting the legs. A shaft 15 extends between the inner ends of the arms within the torso. The righthand side 15*a* of the shaft is square and fits snugly within a corresponding opening in the inner end of one arm 9, as shown in FIG. 3. This inner end is provided with a pair of spaced parallel arcuate ribs 17 and 19 on either side of its square opening and between which the squared portion of the shaft is captured. The left hand portion of shaft 15 is square in cross-section and is cut into two parts 15*a* and 15*b* as shown in FIG. 2*a*. A sleeve S couples both parts together, the sleeve having a square opening and being pressed at one end onto portion 15*b* of the shaft. The opposite end of the sleeve, into which portion 15*a* of the shaft extends, is slitted axially so as to be capable of rotation on the part 15*a* by its inherent resiliency when the arm 7 is rotated. Secured to the inner end of each of the arms 7 and 8 is a respective projecting lug 25, 25*a* in which are anchored the ends of a tension spring 27 extending therebetween. The spring serves to return the arms to their original position when moved away therefrom and also to retain the ribs 17, 19 and 20, 22 against the flanges 16 and 18, respectively.

Secured to the inner ends of arms 7 and 9 respectively, are inwardly extending fingers 29 and 29*a* of substantially equal length. When the arms are positioned forwardly as shown in FIG. 2 with the palms of the hands facing each other, the fingers 29 and 29*a* extend into the path of arms 31 of a bell crank lever 33. As shown in FIG. 3, the bell crank is pivoted about a pin 34 mounted between spaced ribs 36 molded in the torso. The other arm of the bell crank is articulated to the closed free end of a bellows member 35*a*. The opposite open end of the bellows is secured to a support 37. A hollow tube 39*a* extends through an opening in the support and into the opening in the bellows. By forcing air into the bellows through the tube, the bellows expands to move the arms 31 of the bell crank against the fingers 29, 29*a* to move the hands of the doll, when positioned as to FIG. 2, towards each other to "clap" hands. As is obvious, the arms 7 and 9 are capable of moving toward each other due to rocking movements of the arcuate ribs 17, 19 and 20, 22 on the respective shoulders 16 and 18. When the air pressure in the bellows is relieved, spring 27 returns the arms 7 and 9 and forces fingers 29, 29*a* against arm 31 to collapse the bellows. Thus, by intermittently forcing air into the bellows, the hands of the doll will simulate the "clapping" of hands.

The inner end of arm 9 of the doll is provided with an additional inwardly extending finger 41 angularly spaced from finger 29*a*. By rotating the last named arm from the position shown in FIG. 2 to an upward position as in FIG. 1, finger 29*a* is moved out of the path of movement of lever arm 31 while finger 41 is moved into said path. Thus upon repeated expansion and contraction of bellows 35*a*, the arm 9 will be moved forward and back in a waving motion. Arm 7 may be moved downward so that it no longer moves in a "clapping" mode.

The head 43 of the doll is shown in FIGS. 1 and 3 as mounted on the body in a manner to permit it to nod "yes" and to more to indicate "no". To this end the head which is hollow, is provided internally thereof toward its lower end with a horizontal strut 45 having a central vertical opening therethrough. A vertically extending rocking lever 47 has its upper end provided with two pairs of outwardly projecting opposite shoulders 49 which abut the bottom surface of the strut while its upper face end extends through the central opening therein and is fixed to the strut by means of a spring fastener 51 in a well known manner. The rocking lever is pivotally mounted at 53 to a horizontal disc 55 within the hollow doll body for movements in a vertical plane. The disc is free to rotate between upper and lower guide ribs 57 and 59 and is maintained centered by an intermediate rib 61, the ribs being molded into the torso of the doll. A lever 63 is pivoted at one end about a pin 65 extending between ribs 67 that extend inwardly from the material of the torso. Its upper surface is provided with a notch 69 opening upwardly and into which freely extends the central portion of a wing member 71 which is integral with rocking lever 47. Thus, rocking movements of lever 63 about the pin 65 will cause the head of the doll to nod "yes" by pivoting about the axis 53 in a counterclockwise direction in FIG. 3. A second bellows member 35*b*, mounted in the manner described in connection with the first bellows member 35*a*, is connected to the intermediate portion of lever 63 to rotate it about the axis of pin 65 when the bellows is expanded. A spring 71' seated between a ledge on the torso and a ledge on the lever 63 normally biases the latter to maintain the head in upright position. A hollow tube 39*b* is operatively connected to bellows 35*b* to actuate it by air forced thereinto.

A further lever 73, mounted to pivot about the axis of pin 65 in a manner similar to lever 63, is provided at its upper end with a push finger 75 offset from the center portion of the wing member 71. A spring 76, as shown in FIG. 4, is mounted between conical locaters on the disc 55 and the torso to normally maintain the head of the doll in a forward facing position. When the lever 73 is rotated about the axis of pin 65 by actuation of a bellows 35*c*, the push finger 75 will cause rotation of the wing member 71 together with the disc 55 in a counterclockwise direction in FIG. 4, to rotate the head in a horizontal plane in a "no" gesture. The spring 76 will return the head to normal position upon relieving the air pressure in the bellows. The normal position of the head is indexed by a stop pin 77 on the disc 55 riding in a notch 79 in the rib 59, as shown in FIG. 5.

An alternate method for waving the right arm is shown in FIGS. 6 to 8. The lever 33' is similar to lever 33 of FIG. 3, but has integrally formed thereon a cam 81 which acts against a cam follower 41' on the inner end of the arm 9, causing the latter to pivot toward the head of the doll when the lever is actuated by the bellows. In this manner the doll may be made to "wave" from side to side instead of forward and back as hereinabove described.

The entire pneumatic circuit for actuating each of the bellows 35*a*, 35*b* and 35*c* in order to cause desired movements of the doll's arms or head is shown in FIG. 10. The manner in which the desired part and the manner of its movement is selected, will now be described. Mounted at their centers in side-by-side relation on shaft 15 is a pair of disc members 83 and 85. As mentioned hereinabove, the right hand portion of shaft 15 in FIG. 1 is of square shape in cross-section. Disc member 83 has a central circular opening and is prevented from rotation about the squared portion 15*a* by a projection 84 fixed thereto and held between ribs integral with the torso, as seen in FIG. 8. Disc member 85 is provided with a square opening to receive the square portion of the shaft 15 and is maintained in intimate fact-to-face relation with disc member 83 by a compression spring 87 extending between its outside surface and a flange 88 fixed on the shaft. Flange 90 bears against disc 83 to resist the force of spring 87. As seen in FIGS. 9A to 9D, disc member 83 is provided with openings a, b, c and d therethrough parallel to its axis. Disc member 85 is provided with a groove 89 in the face thereof which is in contact with a face of disc member 83. Groove 89 has an arcuate portion and a radially extending portion. As can be seen from FIG. 10, the disc member 85 can be turned by shaft 15 as the right arm 9 is turned, to connect the arcuate portion of groove 89 with openings a and d in the disc member 83. By turning the disc 85 in a clockwise direction by about 135° from the above described position, the groove 89 will form a free passageway between orifices d and b. A further rotation of the disc through 45° will cause groove 89 to connect orifices d and c in the same manner.

The right leg RL of the doll, as is the left leg LL, is rotatably mounted in a leg socket in the body and retained therein by a flange 91 on the inner end thereof. The leg RL is resilient, hollow and closed except for a projecting tubulation 93 on the inner termination of the leg within the doll body. A hollow tube 95 extends from the opening in tubulation 93 into the opening d in the disc member 83, in the manner shown in FIG. 9A. Additional individual tubes connect openings, a, b and c with a respective openings in bellows members 35*a*, 35*b* and 35*c*. It can thus be seen that by turning the arm 9 of the doll upwardly as in FIG. 1, the disc 85 is in the position shown in FIG. 10, and the bellows 35*a* is pneumatically connected to the right let RL. By intermittently squeezing the leg RL, the bellows 35*a* is activated to cause the arm 9 to be moved forward and backward to provide a "wave" motion. For this purpose the arm 7 may be inactivated by turning it downwardly to remove finger 29 from the path of lever arm 31. Now if the arms 7 and 9 of the doll are turned forwardly to the clap position as shown in FIG. 2, the disc 85 is turned 90° clockwise from the last position shown in FIG. 10, and the openings a and d remain connected. By squeezing the right leg RL, the bellows 35 is activated to force the arms 7 and 9 to move toward each other. If the right arm and hence disc 85 is turned to cause groove 89 to connect openings d and b, compressed air will be directed to bellows 35*b* to cause the doll to nod "yes". Bellows 35*c* will be actuated to cause the doll to make a "no" motion with its head when the right arm is moved to its downward position to connect openings c and d and the right leg is squeezed.

It is readily apparent to one skilled in the art from the above description that other actions may be similarly achieved by adding orifices to the disc member 83 and additional bellows operated mechanisms to actuate other parts of the doll. Thus, for example, the doll may be made to wink, close both eyes, kick or bend at the waist.

FIGS. 11, 12*a* and 13*c* show, by way of example, how the doll may be made to close its eyes or wink. A standard closing eye consisting of a front shell 101, a rear shell 103 and eyeball 105 is typically pivoted by means of pivot pins 107 rotatably mounted in the pivot bearings 109 in the rear shell. The standard eyeball may be modified by the addition of a vane 111 extending from the rear of the eyeball. When the above described parts are assembled as shown in FIG. 11, the vane 111 extends through a slot 113 in the rear shell 109. With the assembled eye in a socket in the head of the doll, the weight of the vane 109 is sufficient to bias the eye to the open positon. A tube 115 extends from within the body with its open end directed toward the bottom of the vane. As before, the tube may extend from an additional orifice in the fixed disc or valve member 83. In this manner, the doll may be made to wink when the right arm is in the appropriate position by diverting air into the added orifice to apply a jet of air against the bottom of the vane.

A modified constructin of the above described responsive doll is shown in FIG. 13. In this modification the bellows for operating the various levers, which in turn actuate respective parts of the doll as hereinabove described, have been omitted. Instead, as can be seen from FIG. 13, each of the levers is provided with an extension which can be operated movably. Thus, lever 33 is provided with an extension 33', lever 63 with extension 63' and lever 73 with extension 73'. These extensions are parallel to each other and terminate at such locations that each of their terminating portions is located in selective alignment with a rotatable arm 121. This arm is secured on the inner end of a shaft (not shown) extending through the outer stiffly yieldable wall of the doll. A knob 123 is secured on the outer end of the shaft for moving the arm 121 into alignment with any one of the selected lever extensions 33', 63' or 73' respectively.

By pushing the knob inwardly, the selected extension is moved to rotate the corresponding lever 33, 63 or 73 about its pivotal axis. Levers 33, 63 and 73 can thus be selectively manually operated to actuate the parts of the doll in the manner previously described. In the present modification, it is understood that each of the levers 33, 63 and 73 are biased to a predetermined position by means of either a compression spring mounted between each lever and the doll wall or by a torsion spring (not shown) mounted on the shafts 34 and 65 which pivotally mounte the levers.

A further modification may employ three separate buttons to selectively actuate the lever extensions 33', 63', and 73'. As shown in FIG. 13*b*, the push buttons are slidably mounted through the back wall of the doll wherein the inner end of each button is in alignment with the ends of the lever extensions 33', 63', and 73'.

Having thus described the invention with the particularity required by the statutes it is apparent that persons skilled in the art may make obvious changes and additions without departing from the spirit and scope of the invention as defined by the following claims.

What is clamed is:

1. A toy figure such as a doll provided with a plurality of movable body parts, means biasing each of said parts to a predetermined position, a plurality of energizable operating means common to and within the doll body for moving a respective one of said parts against its bias and away from such position when energized, manually controlled means cooperable with each of said operating means for intermittently energizing it to reciprocate a corresponding part, and selecting means movably mounted on the doll for effecting cooperation between any one of said operating means and the manually controlled means.

2. A toy figure according to claim 1 wherein said manually controlled means includes a yieldable portion of the doll for applying fluid pressure to said operating means when manually compressed.

3. A toy figure according to claim 2 wherein the fluid is air.

4. A toy figure according to claim 2 wherein said means movably mounted on the doll comprises adjustable valve means selectively connecting the manually controlled means to one of said operating means to divert the compressed air thereto.

5. A toy figure according to claim 2, wherein one of said movable parts is an eyeball pivoted about an axis in an eye-socket in the head, a vane extending from the rear of the eyeball into the head for maintaining it in a predetermined position by gravity, said operating means, upon energization thereof applying a jet of fluid against said vane to cause rotation of said eyeball about the axis.

6. A toy figure according to claim 2 wherein said selecting means includes valve means for transferring the fluid pressure to a selected one of the operating means for energizing it, said valve means including a pair of plates having surfaces in contacting relation and mounted for relative rotation and comprising the movably mounted selecting means, one of said surfaces being provided with a groove, a plurality of spaced openings in the second plate so located as to register with said groove during a portion of said relative movement, a further opening in the second plate being connected to the source of pressure and continuously registering with said groove during said relative movement, the plurality of said openings being each connected to a respective operating means, whereby one of said plurality of openings may be selectively connected to the source of pressure through the further opening to energize one of said operating means.

7. A toy figure according to claim 6 wherein one of said plates is secured against movement, and means biasing the other of the plates against said one plate the other of said plates being rotatable.

8. A toy figure according to claim 1 such as a doll wherein one of said parts is a movable head, means mounting the head to the body for movements in orthognoal planes, means on the head in cooperative relation with one of said operating means for movement thereby on one said plane and in cooperative relation with another of said operating means for movement thereby in the other said plane when said operating means are respectively energized for effecting movements of the head in respective planes.

9. A toy figure according to claim 8 wherein said operating means are pneumatically actuated.

10. A toy figure according to claim 9 wherein the operating means each include an air operated bellows.

11. A toy figure according to claim 1 wherein the parts include a pair of movable arms, at least one of said arms being operably connected to said selecting means for moving it to effect cooperation between a selected operating means and the manually controlled means.

12. A toy figure according to claim 11 wherein said manually controlled means includes a yieldable portion of the doll for applying fluid pressure to said operating means when manually compressed.

13. A toy figure according to claim 12 wherein the fluid is air.

14. A toy figure according to claim 12 wherein said selecting means comprises valve means for transferring the fluid pressure to a selected one of the operating means for energizing it, said valve means including a pair of plates having surfaces in contacting relation and mounted for relative rotation by movement of said one arm, one of said surfaces being provided with a groove, a plurality of spaced openings in the second plate so located as to register with said groove during a portion of said relative movement, a further opening in the second plate being connected to the source of pressure and continuously registering with said groove during said relative movement, the plurality of said openings being each connected to a respective operating means, whereby one of said plurality of openings may be selectively connected to the source of pressure through the further opening to energize one of said operating means.

15. A toy figure according to claim 14 wherein one of said plates is secured against movement, and means biasing the other of the plates against said one plate and movable in response to movement of said at least one arm.

16. A toy figure such as a doll provided with a plurality of movable body parts, means biasing each of said parts to a predetermined position, at least one movable member cooperable wth each of said parts and mounted in the doll body for moving a corresponding part against its bias and away from such position when actuated, and manually operable means movably mounted on said body for selective engagement with any one of said members and for actuating such member.

17. A toy figure according to claim 16 wherein said manually operable means is mounted on said body for rotation about an axis to select one of said members and in an axial direction to actuate said selected member for moving a corresponding part.

18. A toy figure according to claim 16 wherein the movable parts include a pair of arms normally adjustable to different position, said arms each having an inwardly extending projection cooperating with one of said movable members when actuated, for moving the arms toward and away from each other when they are adjusted to extend forwardly of the body, one of said arms having a second inwardly extending projection cooperating with said member when actuated, for effecting a waving motion of said one arm when adjusted to extend upwardly.

19. A toy figure such as a doll provided with a plurality of movable body parts, means biasing each of said parts to a predetermined position, at least one movable member cooperable with each of said parts and mounted in the doll body for moving a corresponding part against its bias and away from such position when actuated, and manually operable means movably mounted on said body for selectively actuating one of said members, wherein said manually operable means is mounted on said body for rotation about an axis to select one of said members and in an axial direction to actuate said selected member for moving a corresponding part and wherein the movable parts include a pair of arms normally adjustable to different positions.

* * * * *